US010773222B1

(12) United States Patent
Taylor et al.

(10) Patent No.: US 10,773,222 B1
(45) Date of Patent: Sep. 15, 2020

(54) EXTRUSION APPARATUS

(71) Applicants: Graham Jeffrey Taylor, Knoxville, TN (US); Nima Tamaddoni Jahromi, Knoxville, TN (US)

(72) Inventors: Graham Jeffrey Taylor, Knoxville, TN (US); Nima Tamaddoni Jahromi, Knoxville, TN (US)

( * ) Notice: Subject to any disclaimer, the term of this patent is extended or adjusted under 35 U.S.C. 154(b) by 430 days.

(21) Appl. No.: 15/713,628

(22) Filed: Sep. 23, 2017

(51) Int. Cl.
*B01F 5/06* (2006.01)
*B01F 15/02* (2006.01)
*B01F 15/06* (2006.01)

(52) U.S. Cl.
CPC ..... *B01F 5/0685* (2013.01); *B01F 15/0237* (2013.01); *B01F 15/066* (2013.01); *B01F 2015/062* (2013.01)

(58) Field of Classification Search
None
See application file for complete search history.

(56) References Cited

U.S. PATENT DOCUMENTS 3,035,820 A * 5/1962 Todd ..... B01F 3/0807 366/268
3,071,351 A * 1/1963 Brown ..... B01F 5/0685 366/268
6,592,251 B2 * 7/2003 Edwards ..... B01F 5/0685 366/130
7,482,166 B2 * 1/2009 Nollert ..... B01F 11/0082 436/71
7,748,892 B2 * 7/2010 McCoy ..... B01F 5/0685 141/270
2005/0213427 A1 * 9/2005 Steckle, Jr. ..... B01F 3/04446 366/268
2010/0198255 A1 * 8/2010 Ifuku ..... A61B 17/00491 606/214
2011/0160700 A1 * 6/2011 Nakamura ..... A61J 1/20 604/518
2016/0214072 A1 * 7/2016 Kashiwagi ..... B01F 5/0685
2017/0014793 A1 * 1/2017 Taylor ..... B01J 13/04

FOREIGN PATENT DOCUMENTS

DE 4432993 C1 * 6/1996 ..... B01F 15/0225
JP 2005186026 A * 7/2005

* cited by examiner

*Primary Examiner* — Jennifer A Leung
(74) *Attorney, Agent, or Firm* — Gulf Coast Intellectual Property Group

(57) ABSTRACT

An extrusion apparatus configured to releasably secure therein a filter and two syringes so as to provide stability during the extrusion process. The extrusion apparatus includes a body that is rectangular in form. The body includes a top surface wherein the top surface has formed therein a filter receiving member. The filter receiving member is centrally located on the body. Operably coupled to the filter receiving member on opposing sides thereof is a first syringe channel and a second syringe channel. The first syringe channel and the second syringe channel include a passage having an outer wall. The outer wall of the passage of the first syringe channel and the second syringe channel is annular in form and has a circumferential radius that requires longitudinal insertion of syringes and inhibits the upward movement thereof once the syringes are disposed therein. A heating assembly is further included in the body.

14 Claims, 3 Drawing Sheets

EXTRUSION APPARATUS

PRIORITY UNDER 35 U.S.C Section 119(e) & 37 C.F.R. Section 1.78

This nonprovisional application claims priority based upon the following prior United States Provisional Patent Application entitled: Closed-loop temperature control for extrusion apparatus and systems, Application No. 62/505,601 filed May 12, 2017, in the name of Graham Jeffrey Taylor, which is hereby incorporated by reference for all purposes.

FIELD OF THE INVENTION

The present invention relates generally to extrusion apparatus, more specifically but not by way of limitation, an apparatus operable to facilitate the extrusion process of a lipid or other substance wherein the extrusion apparatus includes a block operable to provide alignment and capture of syringes and an extrusion filter.

BACKGROUND

Lipid extrusion is a technique wherein a lipid suspension is forced through a filter, such as but not limited to a polycarbonate filter, wherein the filter has a defined pore size so as to yield particles having a diameter generally equivalent to the pore size of the filter. The end result of the extrusion process is to produce a solution wherein the particle size of the lipid is homogenous. To accomplish the objective, it is routine for the solution to be passed through the filter many times. Preparation for extrusion of lipids generally consists of dissolving lipids in a suitable organic solvent and then evaporating the solvent. Ensuing solvent evaporation and drying of the remaining lipid material an aqueous solution is added to the vessel containing the dried lipid. Next, hydration agitation is performed which will result in the production of large multilmellar vesicles. At this stage, the solution is ready for extrusion in order to produce homogenous small unilammellar vesicles.

The extrusion of the aforementioned solution is commonly executed utilizing two syringes having a filter operably intermediate the two syringes. The filter is configured to homogenize the lipid particles to a desired size. Existing technology utilizes a block that is operable to have secured therein two syringes. These blocks typically have open channels that are designed to accommodate a syringe. Intermediate the open channels is a cavity that is configured to receive and retain a filter housing having a filter disposed therein. An individual performing an extrusion will operably couple one end of the filter to a first syringe and the opposing end of the filter to a second syringe. Ensuing operable coupling of the syringes and the filter, a lipid solution contained in one of the syringes is forced through the filter and into the opposing syringe. This action is executed as many times as needed in order to produce the desired result. One issue with the current technology is the inability to releasably secure the syringes into the body of the extrusion apparatus. Attempts have been made utilizing clamps and the like but these elements have proven ineffective and/or cumbersome to use. Additionally, existing devices do not incorporate an integrated heating technique and currently utilize external heating sources to heat the devices through conductance.

Accordingly, there is a need for an extrusion apparatus that receives and releasably secures therein a first syringe and a second syringe and wherein the extrusion apparatus further includes an integrated heating apparatus.

SUMMARY OF THE INVENTION

It is the object of the present invention to provide an extrusion apparatus configured to facilitate extrusion of a lipid or similar material wherein the extrusion apparatus of the present invention includes a body configured to receive and retain two syringes and a filter housing.

Another object of the present invention is to provide an extrusion apparatus operable to assist in the extrusion process wherein the body of the present invention includes three embodiments.

A further object of the present invention is to provide an extrusion apparatus configured to facilitate extrusion of a lipid or similar material wherein a first embodiment of the body of the present invention includes a centrally located filter receiving cavity.

Still another object of the present invention is to provide an extrusion apparatus operable to assist in the extrusion process wherein the first embodiment of the body further includes a first syringe receiving channel and a second syringe receiving channel configured to receive and releasably secure syringes.

An additional object of the present invention is to provide an extrusion apparatus configured to facilitate extrusion of a lipid or similar material wherein the first syringe receiving channel and the second syringe receiving channel are configured with a circumferential radius operable to retain a syringe therein.

Yet a further object of the present invention is to provide an extrusion apparatus operable to assist in the extrusion process wherein the body of the present invention further includes an integrated heating component.

Another object of the present invention is to provide an extrusion apparatus configured to facilitate extrusion of a lipid or similar material wherein the second embodiment of the body of the present invention includes syringe capture members on opposing sides of a filter receptacle.

Still an additional object of the present invention is to provide an extrusion apparatus operable to assist in the extrusion process wherein the third embodiment of the body of the present invention is configured with opposing syringe mounting members.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
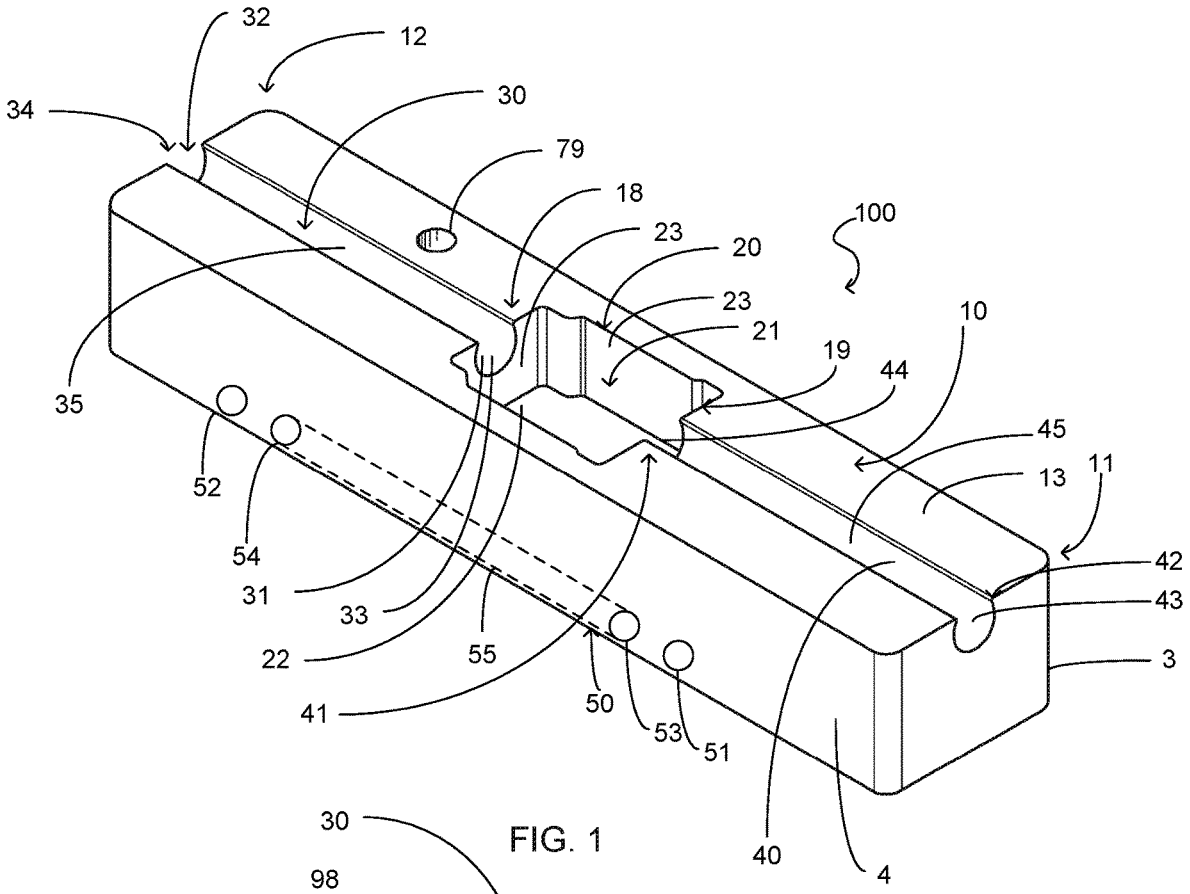
FIG. 1 is perspective view of the first embodiment of the body of the present invention.

Referring now to the drawings submitted herewith, wherein various elements depicted therein are not necessarily drawn to scale and wherein through the views and figures like elements are referenced with identical reference numerals, there is illustrated an extrusion apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
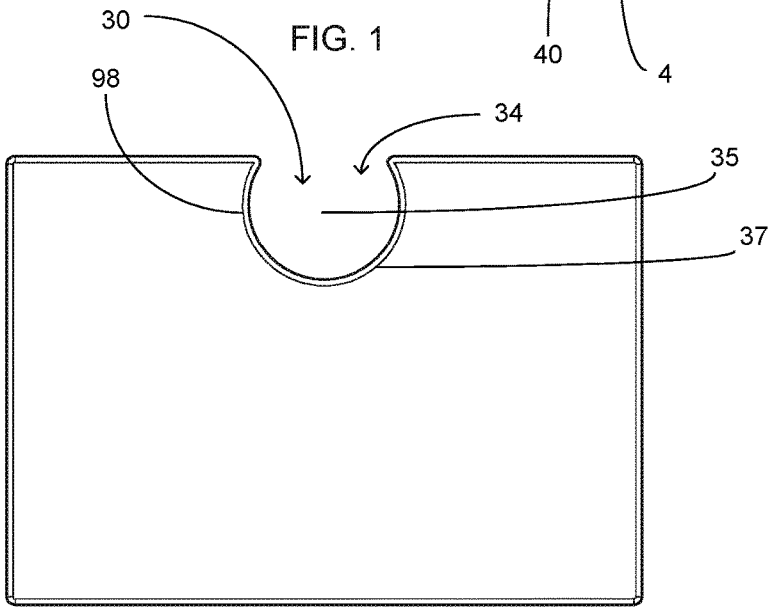
FIG. 2 is an end view of the first embodiment of the body of the present invention.

Referring in particular to FIGS. 1 and 2 herein, the extrusion apparatus 100 includes body 10. The body 10 is manufactured from a durable rigid material such as but not limited to metal. It is further preferred within the scope of the present invention that the body 10 is manufactured from a material that conducts heat therethrough. The body 10 is rectangular in shape having a first end 11, second 12 and further including a top surface 13. It is contemplated within the scope of the present invention that the body 10 could be manufactured in various lengths. The body 10 includes filter receiving cavity 20 formed therein. The filter receiving cavity includes first end 18 and second end 19. The filter receiving cavity 20 includes opening 21 and bottom 22 and is defined by walls 23. The filter receiving cavity 20 is sized and shaped so as to releasably receive a conventional filter and/or extruder encased in a housing such as but not limited to a polycarbonate filter utilized for lipid extrusion. It should be understood by those skilled in the art that the extrusion apparatus 100 functions to releasably secure a filter and/or extruder wherein the filter and/or extruder is operable to extrude materials such as but not limited to lipids, liposomes, polymersome, proteins, and any other nano- and macro-scale particles. The filter receiving cavity 20 is formed within the body 10 utilizing suitable techniques and is formed so as to have a depth that is generally equivalent to the radius of the filter and/or extruder housing configured to be disposed therein. The shape of the filter receiving cavity 20 illustrated herein is a shape that is configured to be mateably engaged with a filter and/or extruder housing having a corresponding shape. It is contemplated within the scope of the present invention that the shape of the filter receiving cavity 20 could be formed in numerous shapes in order to mateably accommodate a filter and/or extruder housing of an alternate shape.

Contiguously formed with the filter receiving cavity 20 proximate first end 18 thereof is the first syringe channel 30. The first syringe channel 30 includes first end 31 and second end 32 having openings 33,34. The first syringe channel 30 includes passage 35 wherein the passage extends intermediate the first end 31 and second end 32. First syringe channel 30 is configured to receive and releasably secure therein a conventional syringe. As will be further discussed herein, the first syringe channel 30 is formed with a circumferential radius that requires insertion of a syringe into second end 32 and subsequently traversed through passage 35 in order to engage a filter proximate first end 18.

A second syringe channel 40 is contiguously formed with the filter receiving cavity 20 proximate second end 19. The second syringe channel 40 includes first end 41 and second end 42 having openings 44,43. The second syringe channel 40 includes passage 45 extending intermediate first end 41 and second end 42. The second syringe channel 40 is configured similarly to the first syringe channel 30 so as to receive and releasably secure therein a syringe during operable engagement with a filter disposed in the filter receiving cavity 20.

Referring in particular to FIG. 2 herein, and end view of body 10 is illustrated therein. The end view illustrates the unique construction of the first syringe channel 30 and second syringe channel 40. It should be noted that the end view illustrated in FIG. 2 for exemplary purposes will be discussed hereafter as the first syringe channel 20 but it is of record that the second syringe channel 40 is identically constructed. The first syringe channel 30 is formed so as to create a specific circumferential radius operable to retain a syringe therein and inhibit the ability for a syringe to be inserted and/or removed from the top opening 39 of the passage 35. The first syringe channel 30 is formed in the body 10 so as to have a circumferential radius that is greater than one hundred and eighty degrees. Construction of the first syringe channel 30 with the aforementioned circumferential radius requires a syringe to be inserted into second end 32 and moved through passage 35 to first end 31. As the circumferential radius of the first syringe channel 30 is greater than one hundred and eighty degrees, a syringe disposed therein is unable to propagate through the top opening 39 thus providing a secure fit of a syringe into the body 10. It is contemplated within the scope of the present invention that the circumferential radius of the first syringe channel 30 could be within the range of one hundred and eighty one degrees to three hundred and thirty degrees. A complete enclosure of a syringe is undesirable as visibility of a solution in a syringe is preferred. While the passage 35 has an outer wall 98 that is annular in form, it is contemplated within the scope of the present invention that the outer wall 98 of the passage 35 could be formed in alternate shapes and achieve the desired function of retaining a syringe therein and requiring the insertion of the syringe in a longitudinal direction. By way of example but not limitation, the outer wall 98 could be modified triangular in form and accomplished the desired objective herein.

Referring again to FIG. 1 herein, the extrusion apparatus 100 further includes a temperature control assembly 50. The temperature control assembly 50 includes ports 51,52 that are bored through the front wall 4 of the body 10 utilizing suitable durable techniques. Ports 51,52 are bored into body 10 but do not penetrate through to rear wall 3. The ports 51,52 are operable to receive a temperature control element therein so as to provide an increase and/or a decrease in temperature of the body 10 during utilization of the extrusion apparatus 100 if desired. While two ports 51,52 are illustrated herein being opposedly located on the body 10, it is contemplated within the scope of the present invention that the body 10 could be configured with as few as one port or more than two ports wherein the ports are configured to receive a temperature control element therein. It is further contemplated within the scope of the present invention that the ports 51, 52 could be configured to receive numerous types of temperature control elements such as but not limited to resistive heating elements or Peltier elements.

The body 10 further includes apertures 53,54 that are operably coupled with passage 55. Apertures 53,54 are formed in the body 10 utilizing suitable techniques and are fluidly coupled with passage 55. Passage 55 is hollow and is operable to allow a fluid that is thermally controlled from an external source to be introduced therethrough. Apertures 53,54 and passage 55 provide an alternate technique to control the temperature of the body 10 during the extrusion process. It is contemplated within the scope of the present invention that the passage 55 could have a fluid flow therethrough that is operable to either increase or decrease the temperature of the body 10. While the passage 55 is illustrated herein as being formed longitudinally within the body 10 intermediate apertures 53, 54 it is contemplated within the scope of the present invention that the body 10 could have a passage 55 formed therein of various different shapes and locations. Furthermore, it is contemplated within the scope of the present invention that the body 10 could have more than one passage 55.

Body 10 includes hole 79. Hole 79 is journaled into top surface 13 utilizing suitable durable techniques. Hole 79 is formed to partially penetrate body 10 and is annular in shape. The hole 79 is configured to receive therein a thermocouple, thermometer or other temperature recording device. While a specific location for the hole 79 is illustrated herein it is contemplated within the scope of the present invention that the hole 79 could be formed in numerous locations of the body 10. It is further contemplated within the scope of the present invention that the hole 79 could be formed in alternate shapes so as to accommodate a temperature recording device of a different form.

Figure 3:
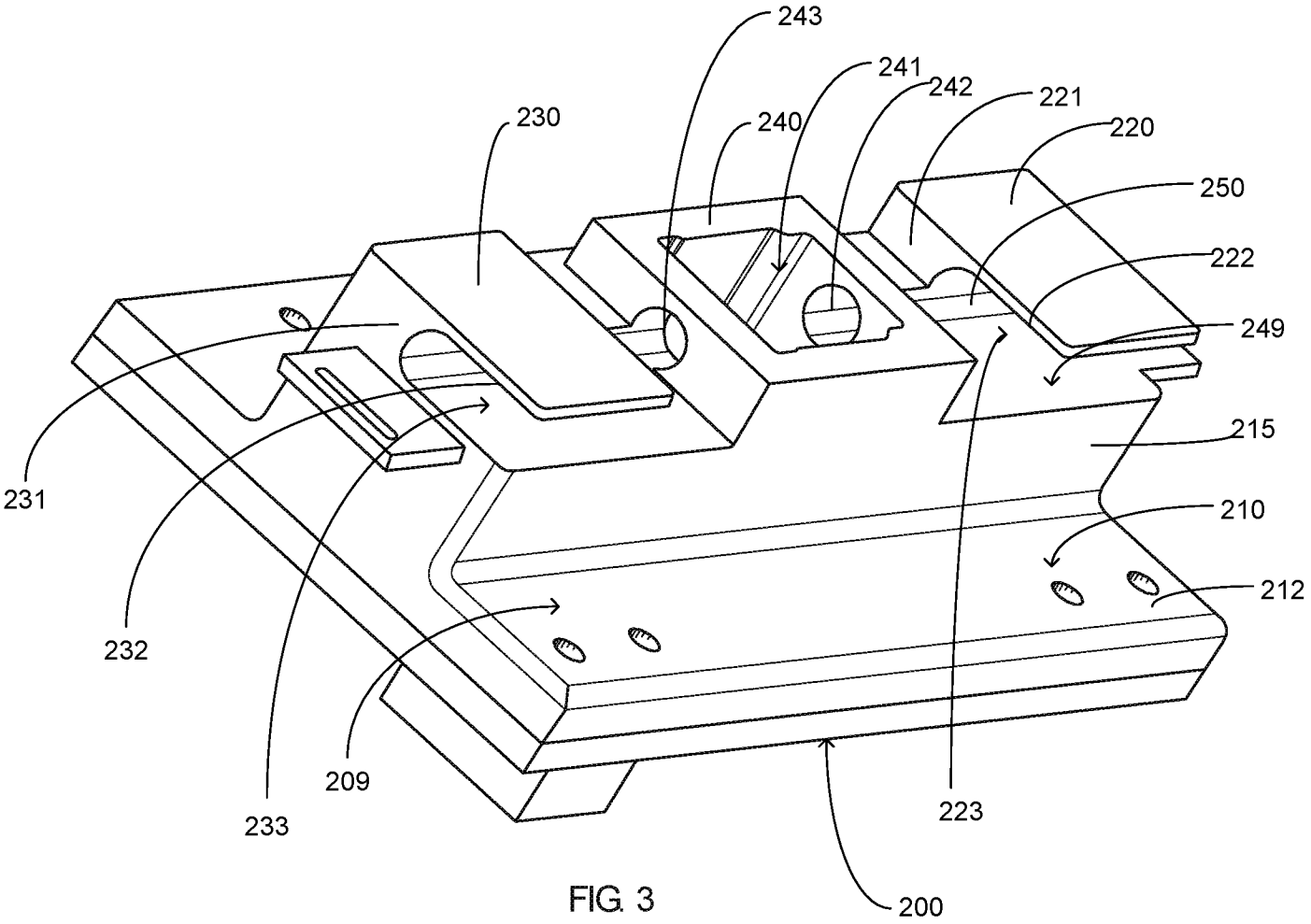
FIG. 3 is a perspective view of a second embodiment of the body of the present invention.

Illustrated herein in FIG. 3 is an alternative embodiment of the body 200 of the extrusion apparatus 100. The body 200 is configured to be operably coupled to an automated extrusion instrument that includes syringes having automated control. The body 200 is manufactured from a suitable rigid material such as but not limited to metal. The body 200 includes a base member 210 having a lower portion 212 and upper portion 215 contiguously formed. The lower portion 212 is planar in manner and is generally rectangular in shape. Upper portion 215 extends outward from the upper surface 209 of the lower portion 212. Upper portion 215 has contiguously formed therewith a first syringe mount 220, a second syringe mount 230 and a filter receiving member 240. The filter receiving member 240 includes cavity 241 that is shaped to mateably receive a filter and/or extruder disposed in a housing. While a specific shape for the cavity 241 is illustrated herein, it is contemplated within the scope of the present invention that the cavity 241 could be formed in various sizes and shapes so as to mateably accommodate a filter and/or extruder housing. Filter receiving member 240 includes first opening 242 and second opening 243 that are operably coupled with cavity 241 and function to permit a portion of a syringe to be operably coupled to a filter and/or extruder disposed within the cavity 241.

The first syringe mount 220 is integrally formed with the upper portion 215 and includes vertical member 221 and horizontal member 222. Vertical member 221 extends upward from the upper portion 215 and has perpendicularly coupled thereto the horizontal member 222. The vertical member 221 extends sufficiently outward from the upper portion 215 in order to create void 223. Void 223 is of suitable size so as to accommodate a portion of a syringe body therein. Groove 250 is formed in the top surface 249 of the upper portion 215 and extends longitudinally towards second syringe mount 230. Groove 250 is formed so as to have a circumference that is configured to mateably engage a body of a syringe so as to provide releasable securing thereof in conjunction with the horizontal member 222.

Body 200 further includes a second syringe mount 230. Second syringe mount is formed identically to the first syringe mount 220. Second syringe mount 230 is located distally to the first syringe mount 220 and includes a vertical member 231 having a horizontal member 232 perpendicularly formed therewith. Vertical member 231 extends sufficiently upward from the upper portion 215 so as to create void 233 intermediate upper portion 215 and the horizontal member 232. Void 233 is of sufficient size so as to accommodate a portion of a body of a syringe. While a temperature control assembly 50 is not illustrated in body 200, it is contemplated within the scope of the present invention that the body 200 could be configured with a temperature control assembly 50 as discussed herein for body 10.

Figure 4:
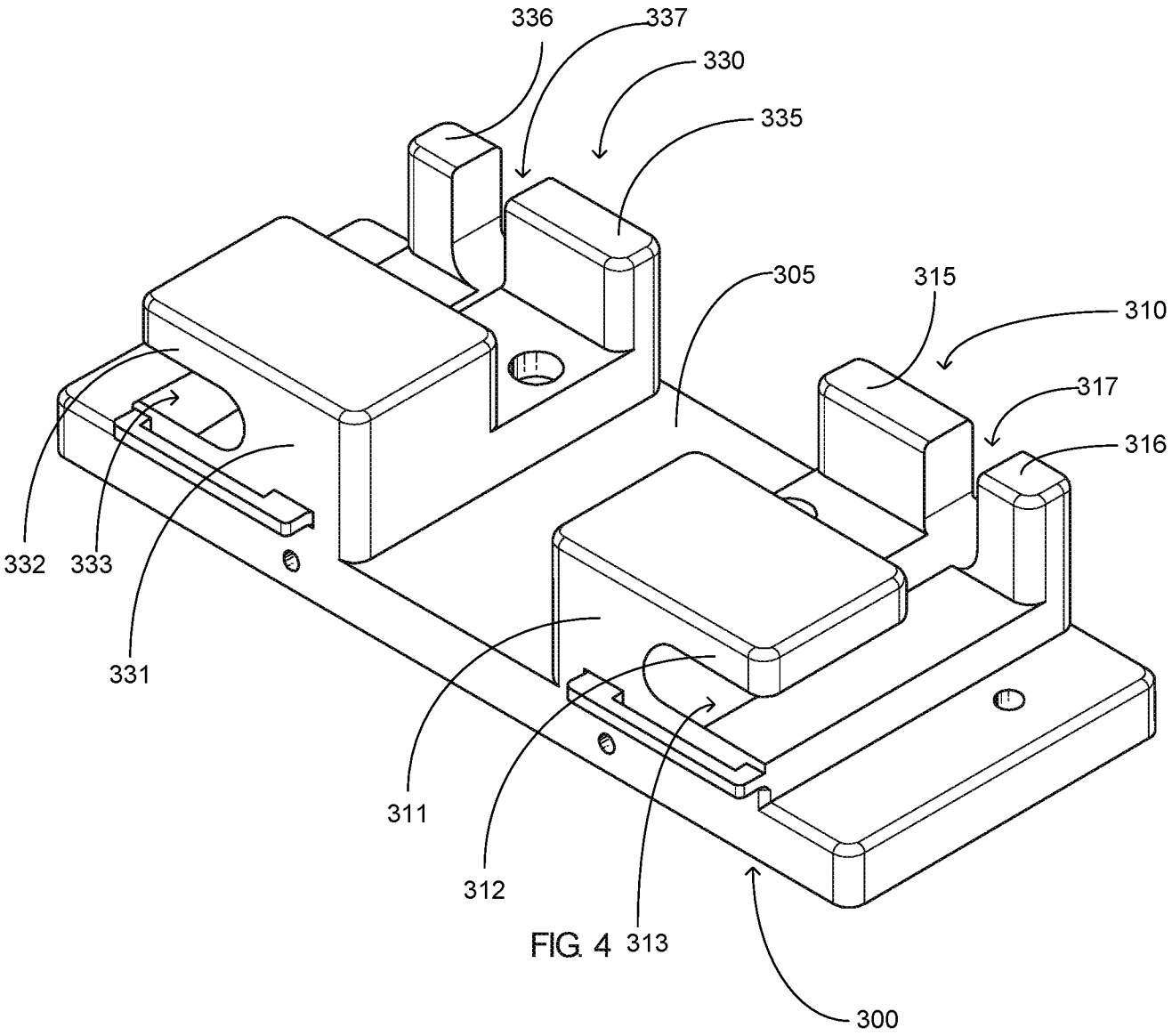
FIG. 4 is a perspective view of a third embodiment of the body of the present invention.

Now referring in particular to FIG. 4, an alternative embodiment of the body 300 of the extrusion apparatus is illustrated therein. The body 300 is configured to be operable coupled to an extrusion instrument wherein the filter or extruder executing the extrusion is operably coupled to the instrument. Body 300 includes lower portion 305, first syringe mount 310 and second syringe mount 330. The body 300 is manufactured from a durable rigid materials and the lower portion 305 is planar in manner and rectangular in shape. The first syringe mount 310 is contiguously formed with the lower portion 305 and extends upward therefrom. The first syringe mount 310 includes a vertical member 311 that has perpendicularly formed therewith a horizontal member 312. Horizontal member 312 has void 313 underneath that is of suitable size to accommodate a portion of a syringe body therein. A first syringe support member 315 and second syringe support member 316. The first syringe support member 315 and second syringe support member 316 extend upward from lower portion 305 and have space 317 intermediate thereto. The first syringe support member 315 and second syringe support member 316 function to inhibit lateral movement of a syringe operably coupled with the first syringe mount 310. While a temperature control assembly 50 is not illustrated in body 300, it is contemplated within the scope of the present invention that the body 300 could be configured with a temperature control assembly 50 as discussed herein for body 10.

The second syringe mount 330 is constructed similarly to the first syringe mount 310 and includes vertical member 331, horizontal member 332 formed identically to vertical member 311 and horizontal member 312. Void 333 is present underneath horizontal member 332 and is of suitable size to accommodate a portion of a syringe body therein. A third syringe support member 335 and fourth syringe support member 336 having a space 337 therebetween. The structural formation of the vertical member 311 and horizontal member 312 in conjunction with the third syringe support member 335 and fourth syringe support member 336 is operable to releasably secure a syringe ensuing being operably coupled thereto.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An extrusion apparatus comprising:

a body, said body being manufactured from a rigid material, said body having a first end and a second end, said body having a top surface, said body further including a heat assembly, said heat assembly having at least one port, said at least one port configured to receive a temperature controlling element operable to alter the temperature of said body;

a filter receiving cavity, said filter receiving cavity having walls and a bottom defining the interior volume thereof, said filter receiving cavity having a first end and a second end, said filter receiving cavity configured to mateably receive and retain a filter;

a first syringe channel, said first syringe channel being formed in the top surface of said body, said first syringe channel extending from said first end of said body to said first end of said filter receiving cavity and being operably coupled thereto, said first syringe channel having a wall formation configured to retain a first syringe therein;

a second syringe channel, said second syringe channel being formed in the top surface of said body, said second syringe channel extending from said second end of said body to said second end of said filter receiving cavity and being operably coupled thereto, said second syringe channel having a wall formation configured to retain a second syringe therein, wherein the first syringe channel and the second syringe channel include a passage, said passage of said first syringe channel and said second syringe channel have an outer wall that is annular in form, said outer wall being formed so as to releasably secure said first syringe and said second syringe within said first syringe channel and said second syringe channel respectively and wherein the outer wall of said passage has a circumferential radius that is greater than one hundred and eighty degrees; and wherein the extrusion apparatus is configured to have inserted therein the first syringe and the second syringe in a longitudinal direction so as to releasably secure the first syringe and the second syringe while engaged with the filter disposed in said filter receiving cavity.

2. The extrusion apparatus as recited in claim 1, wherein said body further includes at least one hole, said at least one hole being partially journaled through into said body, said at least one hole configured to have inserted therein a temperature recording device.

3. The extrusion apparatus as recited in claim 2, wherein the body is manufactured from a material that is configured to conduct heat.

4. An extrusion apparatus configured to releasably secure a filter disposed in a housing and facilitate extrusion of a lipid comprising:

a body, said body being manufactured from a rigid material, said body having a first end and a second end, said body having a top surface;

a filter receiving cavity, said filter receiving cavity being centrally located on said body, said filter receiving cavity having walls and a bottom defining the interior volume thereof, said filter receiving cavity having a first end and a second end, said filter receiving cavity configured to mateably receive and retain said filter;

wherein the body is configured to have longitudinally inserted therein a first syringe and a second syringe, wherein the first syringe is inserted into said body proximate said first end and wherein said second syringe is inserted into said body proximate said second end and wherein the body is configured to inhibit upward movement of the first syringe and the second syringe subsequent insertion thereof; and a temperature control element, said body further having said temperature control element configured to operably couple with a temperature control member that is operable to alter the temperature of the body.

5. The extrusion apparatus as recited in claim 4, wherein said body further includes a first syringe channel, said first syringe channel being formed in the top surface of said body, said first syringe channel extending from said first end of said body to said first end of said filter receiving cavity and being operably coupled thereto, said first syringe channel having an outer wall, said outer wall configured to retain said first syringe within said first syringe channel, and further including a second syringe channel, said second syringe channel being formed in the top surface of said body, said second syringe channel extending from said second end of said body to said second end of said filter receiving cavity and being operably coupled thereto, said second syringe channel having an outer wall, said outer wall configure to retain said second syringe within said second syringe channel.

6. The extrusion apparatus as recited in claim 5, wherein said outer wall of said first syringe channel and said outer wall of said second syringe channel has a circumferential radius that is greater than one hundred and eighty degrees.

7. The extrusion apparatus as recited in claim 4, wherein said body further includes a base member, said base member having a lower portion and an upper portion, said lower portion and said upper portion being contiguously formed, said upper portion having said filter receiving cavity formed therein, said filter receiving cavity having a first opening and a second opening on opposing sides thereof, said base member further including a first syringe mount and a second syringe mount, said first syringe mount and said second syringe mount being on opposing sides of said filter receiving cavity, said first syringe mount having a vertical member and a horizontal member wherein said horizontal member is contiguous and perpendicular with said vertical member, said second syringe mount having a vertical member and a horizontal member wherein said horizontal member is contiguous and perpendicular with said vertical member.

8. The extrusion apparatus as recited in claim 6, and further including a first aperture and a second aperture, said first aperture and said second aperture having a passage operably coupled intermediate thereto, said passage configured to facilitate a fluid flow therethrough wherein the fluid is operable to alter the temperature of the body.

9. The extrusion apparatus as recited in claim 8, wherein the circumferential radius of the outer wall of the first syringe channel and second syringe channel ranges from one hundred and eighty-one degrees to three hundred and thirty degrees.

10. The extrusion apparatus as recited in claim 5, wherein said body further includes a hole, said hole being partially journaled through into said body, said hole configured to have inserted therein a temperature recording device.

11. An extrusion apparatus configured to releasably retain a filter and a first syringe and second syringe during an extrusion process comprising:

a body, said body being manufactured from a rigid material that is further configured to conduct heat, said body being rectangular in shape, said body having a first end and a second end, said body having a top surface;

a filter receiving cavity, said filter receiving cavity having walls and a bottom defining the interior volume thereof, said filter receiving cavity having a first end and a second end, said filter receiving cavity configured to mateably receive and retain the filter;

a first syringe channel, said first syringe channel being formed in the top surface of said body, said first syringe channel extending from said first end of said body to said first end of said filter receiving cavity and being operably coupled thereto, said first syringe channel having a passage being formed by an outer wall, said outer wall being annular in form;

a second syringe channel, said second syringe channel being formed in the top surface of said body, said second syringe channel extending from said second end of said body to said second end of said filter receiving cavity and being operably coupled thereto, said second syringe channel having a passage, said passage being formed by an outer wall, said outer wall being annular in form;

a temperature control assembly, said temperature control assembly including at least one port, said at least one port being formed in said body, said at least one port configured to receive therein a temperature control element; and wherein the outer wall of said passage of said first syringe channel and the outer wall of said passage of said second syringe channel have a circumferential radius being greater than one hundred and eighty degrees.

12. The extrusion apparatus as recited in claim 11, and further including a first aperture and a second aperture, said first aperture and said second aperture having a passage operably coupled intermediate thereto, said passage configured to facilitate a fluid flow therethrough wherein the fluid is operable to alter the temperature of the body.

13. The extrusion apparatus as recited in claim 12, wherein said body further includes a hole, said hole being partially journaled through into said body, said hole configured to have inserted therein a temperature recording device.

14. The extrusion apparatus as recited in claim 13, wherein the circumferential radius of the outer wall of the passage of the first syringe channel and second syringe channel ranges from one hundred and eighty-one degrees to three hundred and thirty degrees.

* * * * *